US006612438B2

(12) United States Patent
Kronenberger

(10) Patent No.: US 6,612,438 B2
(45) Date of Patent: Sep. 2, 2003

(54) CUSHIONING INSERT FOR PLACEMENT WITHIN A CONTAINER RECEPTACLE

(76) Inventor: Robert Kronenberger, 1180 Hamilton, Deerfield, IL (US) 60015

( * ) Notice: Subject to any disclaimer, the term of this patent is extended or adjusted under 35 U.S.C. 154(b) by 0 days.

(21) Appl. No.: 09/879,648

(22) Filed: Jun. 12, 2001

(65) Prior Publication Data

US 2002/0185407 A1 Dec. 12, 2002

(51) Int. Cl.[7] ..... B65D 73/00
(52) U.S. Cl. ..... 206/457; 206/594
(58) Field of Search ..... 206/584, 521.1, 206/521.2, 521.6, 591, 593, 594, 457, 423; 47/41.1

(56) References Cited

U.S. PATENT DOCUMENTS 5,308,677 A * 5/1994 Renna ..... 206/584
5,897,926 A * 4/1999 Mikulas ..... 273/DIG. 13
6,053,323 A * 4/2000 Weder ..... 206/584
6,065,601 A * 5/2000 Weder ..... 206/457
6,293,401 B1 * 9/2001 Weder ..... 206/457
6,298,637 B1 * 10/2001 Weder ..... 53/449
6,385,949 B2 * 5/2002 Weder ..... 206/584
6,401,436 B2 * 6/2002 Weder ..... 53/449

* cited by examiner

*Primary Examiner*—Shian Luong
(74) *Attorney, Agent, or Firm*—Wood, Phillips, Katz, Clark & Mortimer

(57) ABSTRACT

The combination of a container and an insert. The container has a wall which defines an upwardly opening receptacle. The wall has a rim extending around the receptacle, and bounding an opening to the receptacle. The insert consists of a base and a plurality of elongate strands, each having a portion attached to the base and a decorative portion projecting away from the base. The plurality of elongate strands have a density sufficient to provide a cushioning support for an article placed in the receptacle.

25 Claims, 4 Drawing Sheets

CUSHIONING INSERT FOR PLACEMENT WITHIN A CONTAINER RECEPTACLE

BACKGROUND OF THE INVENTION

1. Field of the Invention

This invention relates to receptacles into which discrete objects can be placed and, more particularly, to an insert for placement within the receptacle to provide a cushioning layer for an object placed therewithin.

2. Background Art

It is common to place objects in containers for display and/or shipping. One example of this is a seasonal basket, such as the straw basket shown at 10 in FIGS. 1–3. The basket 10 has a wall 12 defining an upwardly opening receptacle 14. An upper rim 16 bounds an opening through which objects can be introduced to the receptacle 14. An inverted, U-shaped handle 18 has spaced ends 20,22 which are attached to the wall 12 to define a graspable element through which the basket 10 can be lifted and transported.

This structure is typically used to send a "gift basket" with a seasonal theme. As one example, this type of basket is used commonly during the Easter holiday. Typically, a bulk supply of discrete, intermeshed, elongate strands 24 are packed into the receptacle 14 to define a cushioning layer to support discrete objects placed therewithin, so that they are readily visible at the top of the basket 10 and spaced protectively from direct contact with the basket. As just one example, Easter eggs 26, shown in FIG. 3, are placed on bulk-packed strands 24 which define a "pillow" that supports the objects and shields them from unwanted contact with each other and the basket 10. Typically, such elongate strands 24 are made from rubber, plastic, paper, or straw. As an example, shredded paper can be packed into the receptacle 14. The integrity of the "pillow" defined by the bulk-packed strands 24 is maintained by the intermeshing of the strands 24.

What generally occurs is that the strands 24 become separated from each other and the basket 10, as the discrete objects 26 are removed from the receptacle 14, so that they litter the area surrounding the basket 10. This occurs because, as seen most clearly in FIG. 2, the strands remain in the accumulated state only by reason of the intermeshing. The strands 24 may separate under a minimal force, as small as a static force adhering the strands 24 to an object that is removed from the container 10.

The overall result is that the strands 24 that have become separated must be collected for disposal. This may represent a significant inconvenience, particularly in a party environment in which a large number of children are removing objects from the baskets 10. The strands 24 often must be swept up or vacuumed from cloth and carpeted surfaces. The strands 24 tend to be tenacious in adhering to carpeting, particularly with a thick pile or a sculpted pattern.

SUMMARY OF THE INVENTION

In one form, the invention is directed to the combination of a container and an insert. The container has a wall which defines an upwardly opening receptacle. The wall has a rim extending around the receptacle, and bounding an opening to the receptacle. The insert consists of a base and a plurality of elongate strands, each having a portion attached to the base and a decorative portion projecting away from the base. The plurality of elongate strands have a density sufficient to provide a cushioning support for an article placed in the receptacle.

In one form, the receptacle opening has an area and the plurality of elongate strands have a density sufficient to nominally cover the area of the receptacle opening.

The base may be made from a material which allows the base to be formed into and retained in a plurality of different shapes.

The base may have a ring-like shape.

The elongate strands may be made from a flexible material.

The elongate strands may be made from at least one of plastic, rubber, paper, and straw.

In one form, the strands are made from a material that can be formed into a plurality of different shapes and will maintain the plurality of different shapes without external force applied to the strands.

The strands may be attached to the base by being embedded therein. Alternatively, the plurality of strands may be attached to an external surface on the base.

The strands may have an average diameter that is not greater than 1/16 inch.

The plurality of strands may be intermeshed.

In one form, the strands nominally occupy at least one-half the volume of the receptacle.

The strands may project through the receptacle opening to outside of the receptacle.

The basket may include an inverted, U-shaped handle having spaced ends connected to the wall.

In one form, the combination includes at least one discrete holiday-related item supported on the plurality of strands so that the plurality of strands define a cushioning layer between the at least one discrete holiday-related item and both the wall and the base.

The invention is also directed to an insert for placement within a receptacle, with the insert having a base and a plurality of elongate strands having a portion attached to the base and a decorative portion projecting away from the base. The plurality of elongate strands have a density sufficient to provide a cushioning support for an article placed against the plurality of elongate strands with the insert in the receptacle.

The strands may have a density sufficient to provide a cushioning layer between a discrete article placed on the plurality of strands and both the base and an element bounding a receptacle into which the insert is placed.

DETAILED DESCRIPTION OF THE DRAWINGS

Figure 1:
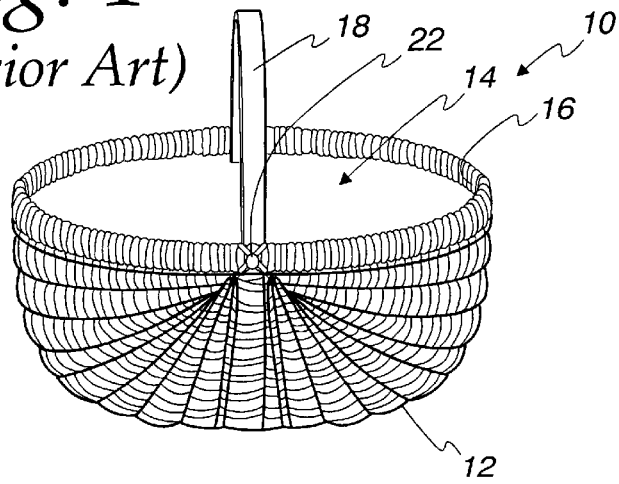
Fig. 1 (Prior Art)
FIG. 1 is a perspective view of a conventional container in the form of a basket used for accepting discrete objects.
Figure 2:
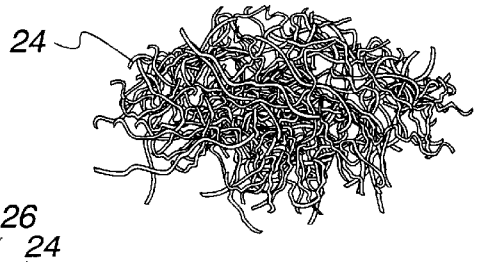
Fig. 2 (Prior Art)
FIG. 2 is a plan view of a plurality of conventional elongate strands which are intermeshed and accumulated for placement within a receptacle such as that defined by the basket in FIG. 1 to produce a cushioning layer.
Figure 3:
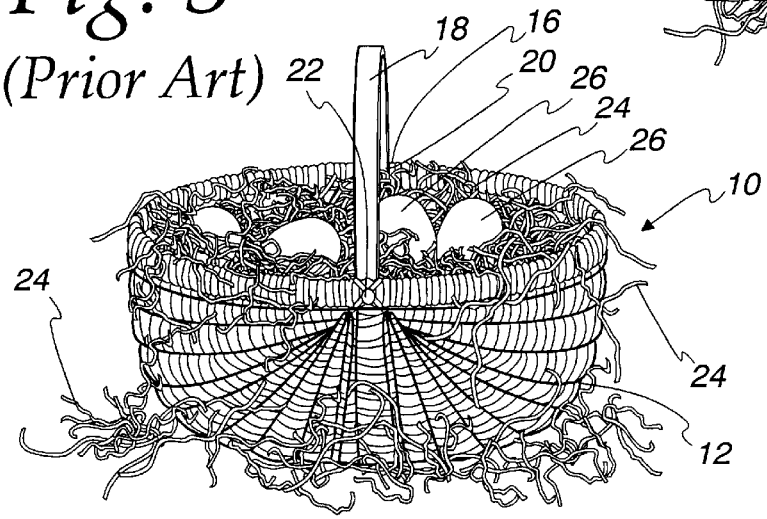
Fig. 3 (Prior Art)
FIG. 3 is an end elevation view of the basket in FIG. 1 with the accumulated and intermeshed strands of FIG. 2 placed therein.
Figure 4:
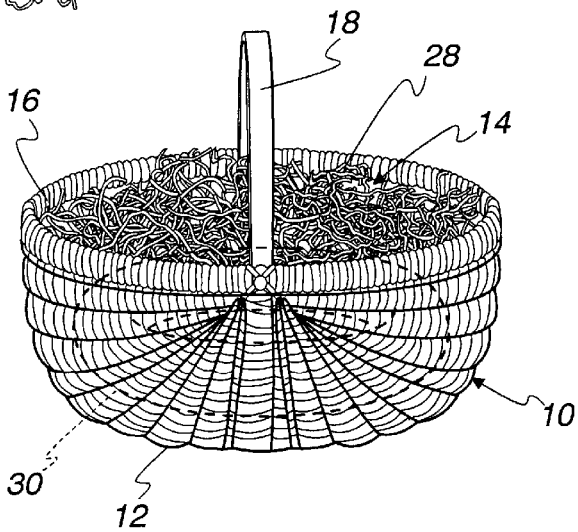
FIG. 4 is a perspective view of a basket, as in FIGS. 1 and 3, with an insert, consisting of a base and attached elongate strands, according to the present invention, directed into a receptacle defined thereby to define a cushioning layer therein.
Figure 5:
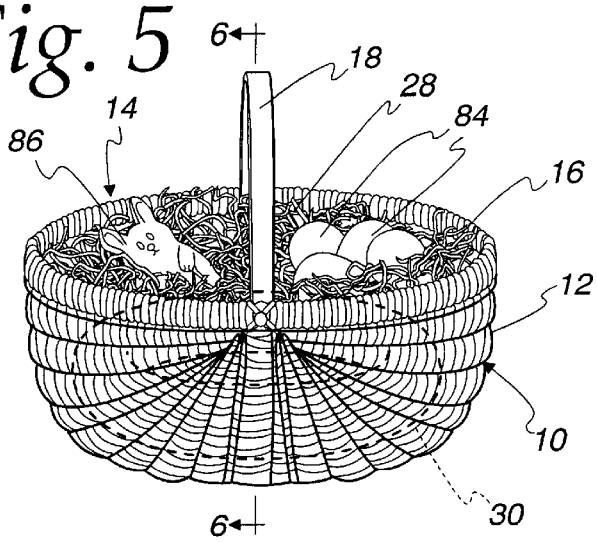
FIG. 5 is a view as in FIG. 4 with discrete objects placed against the accumulated strands in the basket receptacle.
Figure 6:
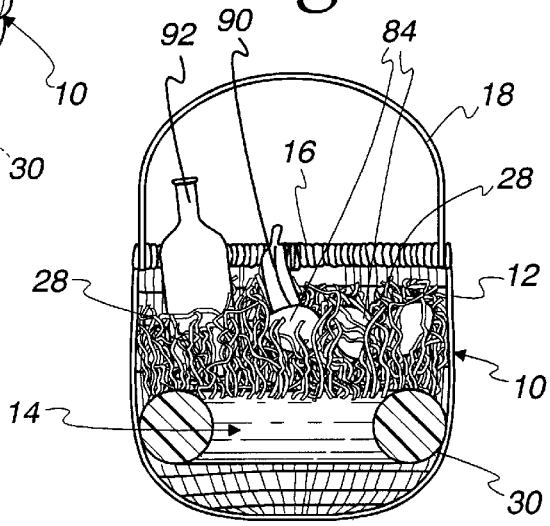
FIG. 6 is a cross-sectional view of the basket and insert taken along line 6—6 of FIG. 5.

Referring initially to FIGS. 4–6, the invention is shown incorporated into the basket 10, having the configuration previously described. The basket 10, as previously noted, has a wall 12 bounding a receptacle 14. A rim 16 bounds an opening through which discrete objects are directed into the receptacle 14. A handle 18 facilitates lifting and transportation of the basket 10.

Figure 7:
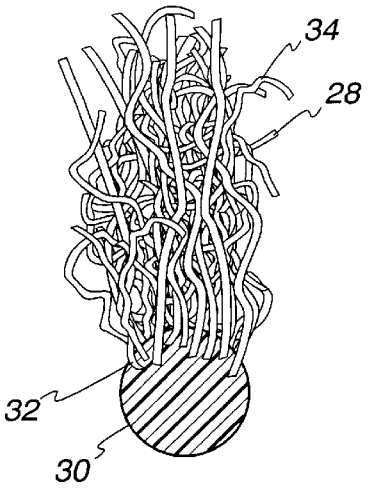
FIG. 7 is a cross-sectional view of a part of a base, according to the invention, in which the strands are attached by embedding.
Figure 8:
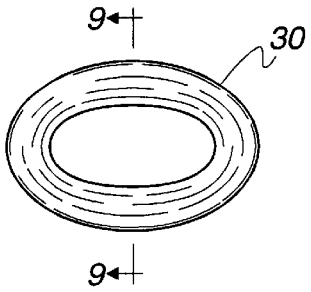
FIG. 8 is a plan view of a base, according to the present invention.
Figure 9:
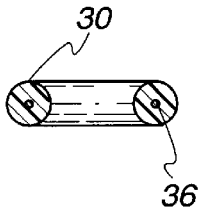
FIG. 9 is a cross-sectional view of the base taken along line 9—9 of FIG. 8.

According to the invention, rather than accumulating and intermeshing discrete strands 24 into a "pillow-type" arrangement, elongate strands 28 are attached to a base 30 so that the plurality of strands 28 and base 30 cooperatively define an insert, as shown also in FIGS. 7–9, which can be directed into the receptacle 14. With the insert directed into the receptacle 14, the accumulated strands 28 define a cushioning layer which shields the discrete objects placed thereon from both the base 30 and the wall 12 of the basket 10.

More particularly, the base 30 is shown in these figures to have a ring-like shape with an exposed surface with a periphery that extends around a majority of the area of the receptacle 14 at which the base 30 is located, as viewed from the top of the basket 10. Preferably, the base 30 is made from a material which allows it to be reconfigured to a plurality of shapes as to conform to different container configurations. In FIGS. 5–9, the base 30 is shown to have a round cross-sectional configuration and an overall elliptical shape so as to conform to the inside surface of the basket wall 12. In FIGS. 8 and 9, the base 30 is shown without any associated strands 28. In FIG. 7, the strands 28 are shown embedded in the base 30. Portions 32 of the strands 28 are embedded in the base 30 so that decorative portions 34 of the strands project therefrom to be exposed for decorative purposes and to perform the cushioning function.

The strands 28 can be made from any of a number of different materials. As just examples, the strands 28 may be made from at least one of plastic, rubber, paper, straw, grass, etc. While the precise nature of the material is not critical, it is desirable that the material making up the strands 28 be flexible. In one form, the material can be such as to permit formation into a plurality of different shapes that will be retained without an external force application to the strands 28.

The dimensions of the strands 28 are dictated by the particular functional and aesthetic requirements. Round or near round cross-sectional shapes may be on the order of 1/16" diameter or less. In case of paper, the strands 28 may be made from relatively narrow strips on the order of ½ inch or less, and preferably ¼ inch or less.

The length of the decorative portions 34 of the strands 28 is selected so that the strands 28 can be intermeshed to occupy the desired volume in the receptacle 14 and also, if desired, to project a desired extent from the receptacle 14. The lengths may be selected so that the strands 28 can be intermeshed to cooperatively produce a cushioning "pillow". As just one example, the density of the strands 28 embedded in the base 30 is selected so that the strands 28 cooperatively have a density that nominally fills the area bounded by the rim. Alternatively, it may be desired to fill a certain volume of the receptacle 14, such as one quarter the volume up to the point that the accumulated strands 28 nominally fill the entire volume and protrude through the opening bounded by the rim 16 to the desired degree. The volume dimension is "nominal" in that the accumulated strands 28 are capable of being compressed to a much smaller volume but in a reasonably relaxed state take up the stated one quarter, one half, or full, volume.

The base 30 can be made from any of a number of different commercially available materials that are flexible and which can be reconfigured to different shapes and which will preferably retain the different shapes. Thus, the different shapes for the base 30 can be preselected and maintained independently of a receptacle into which the base 30 is placed. If necessary, an optional wire-like insert 36 (FIG. 9) can be embedded in the base 30 to facilitate its reconfiguration.

Figure 10:
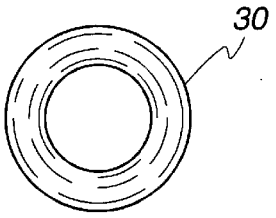
FIG. 10 is a plan view of the base in FIG. 8 reconfigured to a circular shape.
Figure 11:
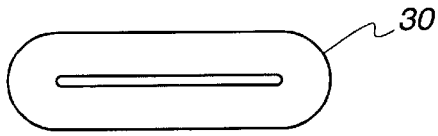
FIG. 11 is a view as in FIG. 10 with the base collapsed to a substantially rectangular overall shape.

The base 30 is preferably reconfigured to match the inside surface of the wall 12 of the receptacle 14, or other suitable wall structure, so as to allow distribution of the strands 28 in the desired manner. For example, the base 30 in ring form can be formed into a round shape, shown in FIG. 10, or collapsed to a relatively solid, rectangular shape, as shown in FIG. 11.

Figure 12:
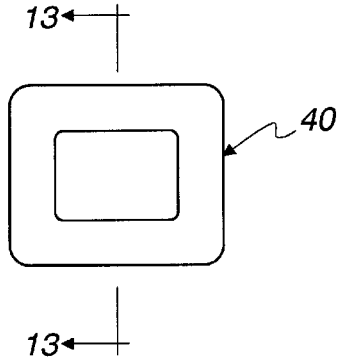
FIG. 12 is a plan view of another form of base, according to the present invention, having a rectangular shape and cross-sectional configuration.
Figure 13:
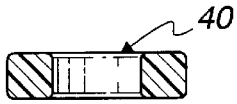
FIG. 13 is a cross-sectional view of the base, taken along line 13—13 of FIG. 12.

In FIGS. 12 and 13, a modified form of base, according to the invention, is shown at 40. The base 40 has a ring-like configuration with a square cross-sectional configuration. The base 40 is also shown to have an overall squared shape. The base 40, like the base 30, and other bases described hereinbelow, may be made with a fixed configuration, but preferably is reconfigurable, as previously described.

Figure 14:
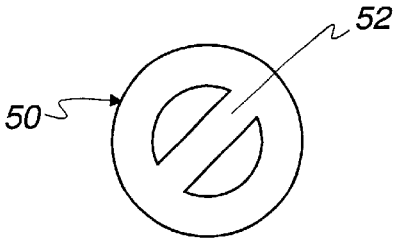
FIG. 14 is a plan view of a further modified form of base, according to the present invention.

In FIG. 14, another form of base is shown at 50 having a ring-like shape with a central region 52 which spans diametrically opposite locations on the generally round base 50. The central region 52 provides additional area to which elongate strands 28 can be applied to make possible further strand density.

Figure 15:
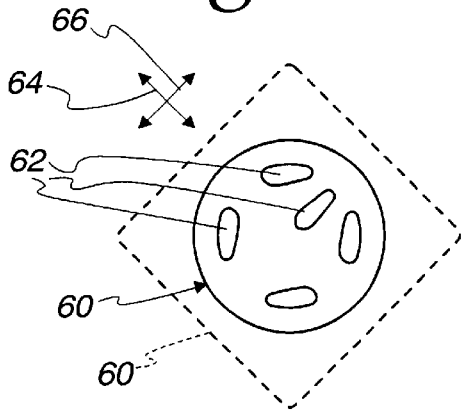
FIG. 15 is a plan view of a still further modified form of base, according to the present invention.

In FIG. 15, a modified form of base is shown at 60. The base 60 has openings 62 formed therein which facilitate the stretching and collapsing of the base 60 in different directions, as indicated by the orthogonal double-headed arrows 64, 66. The base 60 in FIG. 15 in essence has a ring-like shape which permits reconfiguration similarly to the pure-ring configuration of the bases 30,40,50, previously described. As just one example, the base 60 can be reconfigured to the square shape shown in dotted lines.

Figure 16:
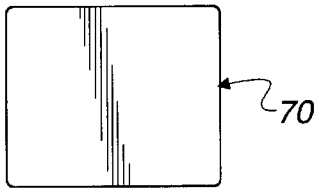
FIG. 16 is a plan view of a still further modified form of base, according to the present invention.

The invention also contemplates a configuration as shown for the base 70 in FIG. 16. The base 70 has a solid shape, and is preferably made from material that will reconfigure readily and maintain a reconfigured arrangement.

Figure 17:
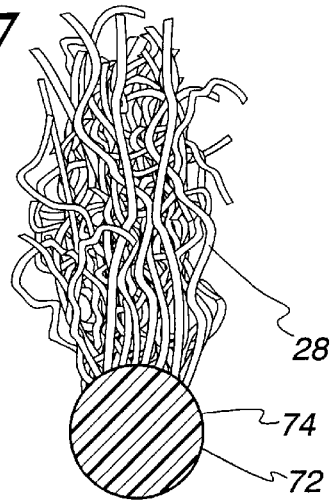
FIG. 17 is a cross-sectional view of a base with strands attached to an outer surface thereof, according to the present invention.

The invention also contemplates that in each embodiment, instead of embedding the strands 28, as shown in FIG. 7, the strands 28 can be adhered to an external surface 72 of a base, as shown generically at 74 in FIG. 17. The attachment may be effected by use of an adhesive, or otherwise.

Figure 18:
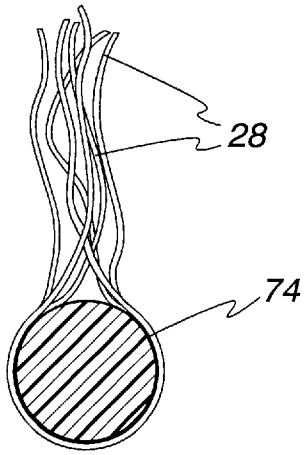
FIG. 18 is a view as in FIG. 17 with the strands wrapped around the outer surface of the base.

In FIG. 18, the base 74 is shown with the strands 28 wrapped therearound to effect attachment, rather than by using an adhesive.

Figure 19:
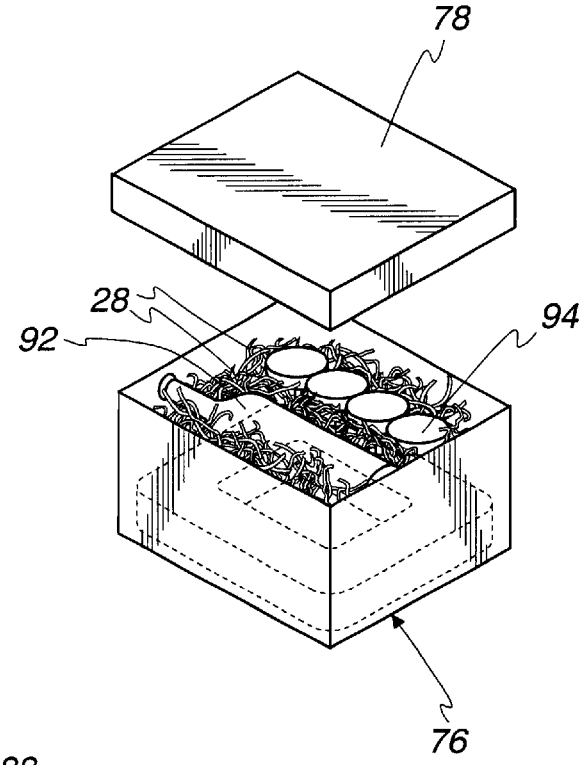
FIG. 19 is a perspective view of a container in the form of a covered box with a cushioning insert, according to the present invention, placed in a receptacle defined thereby and with discrete objects placed thereagainst.

Regardless of the configuration of the insert, once the insert is formed, it is directed into the basket 10, or any other container receptacle, such as the rectangular box 76 with the cover 78, shown in FIG. 19. The insert can be one that is preformed in a fixed shape or one that is reconfigured to a desired shape prior to placement in the basket 10, box 76, or other container, which may take other different forms. The strands 28 can then be appropriately shaped to produce the desired cushioning effect, as is seen additionally in FIGS. 6 and 20. Once this occurs, discrete objects can be placed against the accumulated strands 28 for cushioning and protection from other objects, the bases 30,40,50,60,70, and the walls of the particular basket 10, box 76, or other container.

Figure 20:
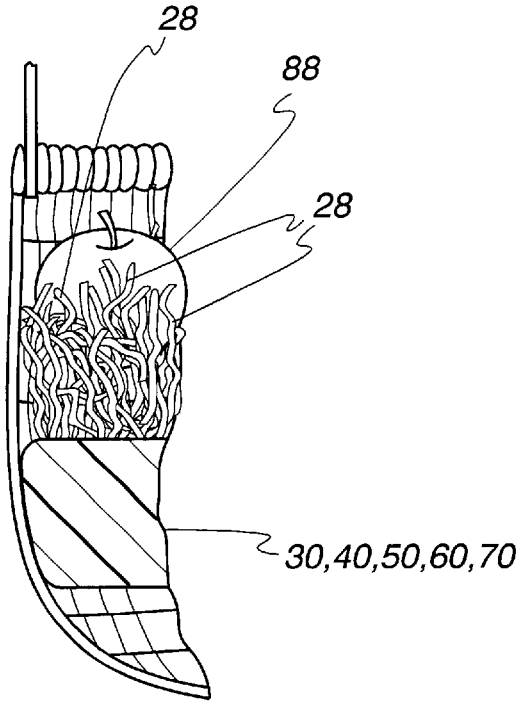
FIG. 20 is a fragmentary, cross-sectional view of the basket of FIG. 5, showing the spaced relationship between the insert and basket and an object placed therewithin.

The nature of the discrete objects placed against the accumulated strands 28 may vary considerably. In FIG. 5, the objects are shown as Easter-related objects, including eggs 84 and candy 86 that may be configured to be associated with a holiday, i.e. such as the rabbit shown in FIG. 5. In FIG. 20, an apple 88 is shown, whereas in FIG. 6, an Easter egg 84, banana 90, and a beverage bottle 92 are shown as representative items. In FIG. 19, a bottle 92 and a glass 94 are shown.

Regardless of the embodiment, the strands 28 remain substantially bound by the bases 30,40,50,60,70, even after the discrete objects are removed. As a result, the strands 28 do not become strewn over the surrounding areas as readily as with conventional packaging.

The foregoing disclosure of specific embodiments is intended to be illustrative of the broad concepts comprehended by the invention.

What is claimed is:

1. In combination:

a) a container having a top and bottom and comprising a wall which defines an upwardly open receptacle,
  the receptacle having an area as viewed from the top of the container,
  the wall having a rim extending around the receptacle and bounding an opening to the receptacle; and b) an insert within the receptacle, the insert comprising:
  i) a base having a predetermined shape which is consistently maintainable independently of the container; and
  ii) a plurality of elongate strands, each strand having a portion attached to the base and a decorative portion projecting away from the base,
    the plurality of elongate strands having a density sufficient to provide a cushioning support for an article placed in the receptacle,
    the base having an external surface with a periphery that extends around a majority of the area of the receptacle at a location in the receptacle at which the base is positioned.

2. The combination according to claim 1 wherein the receptacle opening has an area, and the plurality of elongate strands have a density sufficient to nominally cover the area of the receptacle opening.

3. The combination according to claim 1 wherein the base is made from a material which allows the base to be formed into and retained in a plurality of different shapes.

4. The combination according to claim 3 wherein the base has a ring-like shape.

5. The combination according to claim 1 wherein the base has a ring-like shape.

6. The combination according to claim 5 wherein the ring has a round cross-sectional configuration.

7. The combination according to claim 5 wherein the ring has a square cross-sectional shape.

8. The combination according to claim 1 wherein the elongate strands are made from a flexible material and extend from the external surface over a substantial portion of the external surface.

9. The combination according to claim 1 wherein the elongate strands are made from at least one of plastic, rubber, paper, and straw.

10. The combination according to claim 1 wherein the strands are made from a material that can be formed into a plurality of different shapes and will maintain the plurality of different shapes without an external force applied to the strands.

11. The combination according to claim 1 wherein the plurality of strands are embedded in the base.

12. The combination according to claim 1 wherein the base has an external surface and the plurality of strands are attached to the external surface of the base.

13. The combination according to claim 1 wherein the plurality of strands have an average diameter that is not greater than 1/16 inch.

14. The combination according to claim 13 wherein the plurality of strands are intermeshed.

15. The combination according to claim 14 wherein the receptacle has a volume and the plurality of strands nominally occupy at least one half of the volume.

16. The combination according to claim 14 wherein the decorative portions of a second plurality of the strands project through the receptacle opening to outside of the receptacle.

17. The combination according to claim 1 wherein the container further comprises an inverted, U-shaped handle having spaced ends connected to the wall.

18. The combination according to claim 1 further comprising at least one discrete holiday-related item supported on the plurality of strands so that the plurality of strands define a cushioning layer between the at least one discrete holiday-related item and the wall and the base.

19. The combination according to claim 1 wherein the base is preformed into a first shape and press fit within the receptacle in a substantially fixed predetermined position while being maintained substantially in the first shape.

20. An insert for placement within a receptacle, the insert comprising:

a base; and a plurality of elongate strands, each strand having a portion attached to the base and a decorative portion projecting away from the base, the plurality of elongate strands having a density sufficient to provide a cushioning support for an article placed against the plurality of elongate strands with the insert in a receptacle, wherein the base is made from a material which allows the base to be formed into and retained in a plurality of different shapes which can be preselected and maintained independently of a receptacle into which the insert is placed.

21. The insert according to claim 20 wherein the base has a ring-like shape.

22. The insert according to claim 20 wherein the elongate strands are made from at least one of plastic, rubber, paper, and straw.

23. The insert according to claim 20 wherein the plurality of strands have an average diameter that is not greater than 1/16 inch.

24. The insert according to claim 23 wherein the plurality of strands are intermeshed.

25. The insert according to claim 20 wherein the plurality of strands have a density sufficient to provide a cushioning layer between a discrete article placed on the plurality of strands and the base and an element bounding a receptacle into which the insert is placed.

* * * * *